United States Patent [19]

Bartolucci

[11] 3,982,551

[45] Sept. 28, 1976

[54] FALSE FINGERNAIL KIT

[75] Inventor: Edgar O. Bartolucci, Tuxedo Park, N.Y.

[73] Assignee: Instore Advertising, Inc., Passaic, N.J.

[22] Filed: May 27, 1975

[21] Appl. No.: 580,591

[52] U.S. Cl. ..... 132/73

[51] Int. Cl.[2] ..... A45D 29/00

[58] Field of Search ..... 132/73, 82 R; 206/45.14, 820

[56] References Cited

UNITED STATES PATENTS

| | | | |
|---|---|---|---|
| 2,143,058 | 1/1939 | Decker | 132/82 R |
| 3,136,416 | 6/1964 | Goldrosen | 206/820 |
| 3,485,344 | 12/1969 | Aylott | 206/45.14 |
| 3,747,831 | 7/1973 | Hanson | 206/45.14 |
| 3,835,987 | 9/1974 | Growney | 206/45.14 |

*Primary Examiner*—G.E. McNeill

*Attorney, Agent, or Firm*—Samuelson & Jacob

[57] ABSTRACT

A false fingernail kit in which false fingernail blanks are formed unitary with a surrounding frame having portions establishing an imaginary envelope within which the blanks are enveloped, the frame being placed in a receptacle having a configuration complementary to the imaginary envelope for establishing a package for the kit. The receptacle includes a window for viewing the packaged fingernail blanks and the frame includes portions defining a compartment in the receptacle for receiving a container of adhesive and a container of adhesive remover. The fingernail blanks are each interconnected with the frame at a limited portion of the blank to facilitate tearing the blank from the frame without mutilation of the blank, and the frame includes basal surfaces for resting the frame in alternate orientations upon a support surface during use of the kit.

3 Claims, 4 Drawing Figures

FALSE FINGERNAIL KIT

The present invention relates generally to false fingernails and pertains, more specifically, to the manufacture, packaging and use of a false fingernail kit.

False fingernails are delicate and difficult to handle when manufactured, packaged and when applied. Currently available false fingernail kits are relatively expensive to package and comparatively difficult to use.

It is an object of the present invention to provide an arrangement for a set of false fingernails which renders the false fingernails relatively easy to manufacture, package and use.

Another object of the invention is to provide a false fingernail kit which is relatively inexpensive to assemble and easy to use.

Still another object of the invention is to provide a false fingernail kit which is aesthetically attractive.

A further object of the invention is to provide a false fingernail kit which is compact, yet complete and ready to use.

A still further object of the invention is to provide a complete set of false fingernails which is economical to manufacture and handle.

The above objects, as well as still further objects and advantages, are attained by the invention which may be described briefly as providing, in a false fingernail kit, the improvement comprising a plurality of false fingernail blanks, and a frame unitary with each of the false fingernail blanks, the frame including basal surfaces for resting the frame upon a support surface, each false fingernail blank being interconnected with the frame at a limited portion of the blank, said limited portion being small enough to enable the blank to be torn manually from the frame without mutilation of the blank.

The invention will be more fully understood, while still further objects and advantages will become apparent, by reference to the following detailed description of an embodiment of the invention illustrated in the accompanying drawing, in which.

Figure 1:
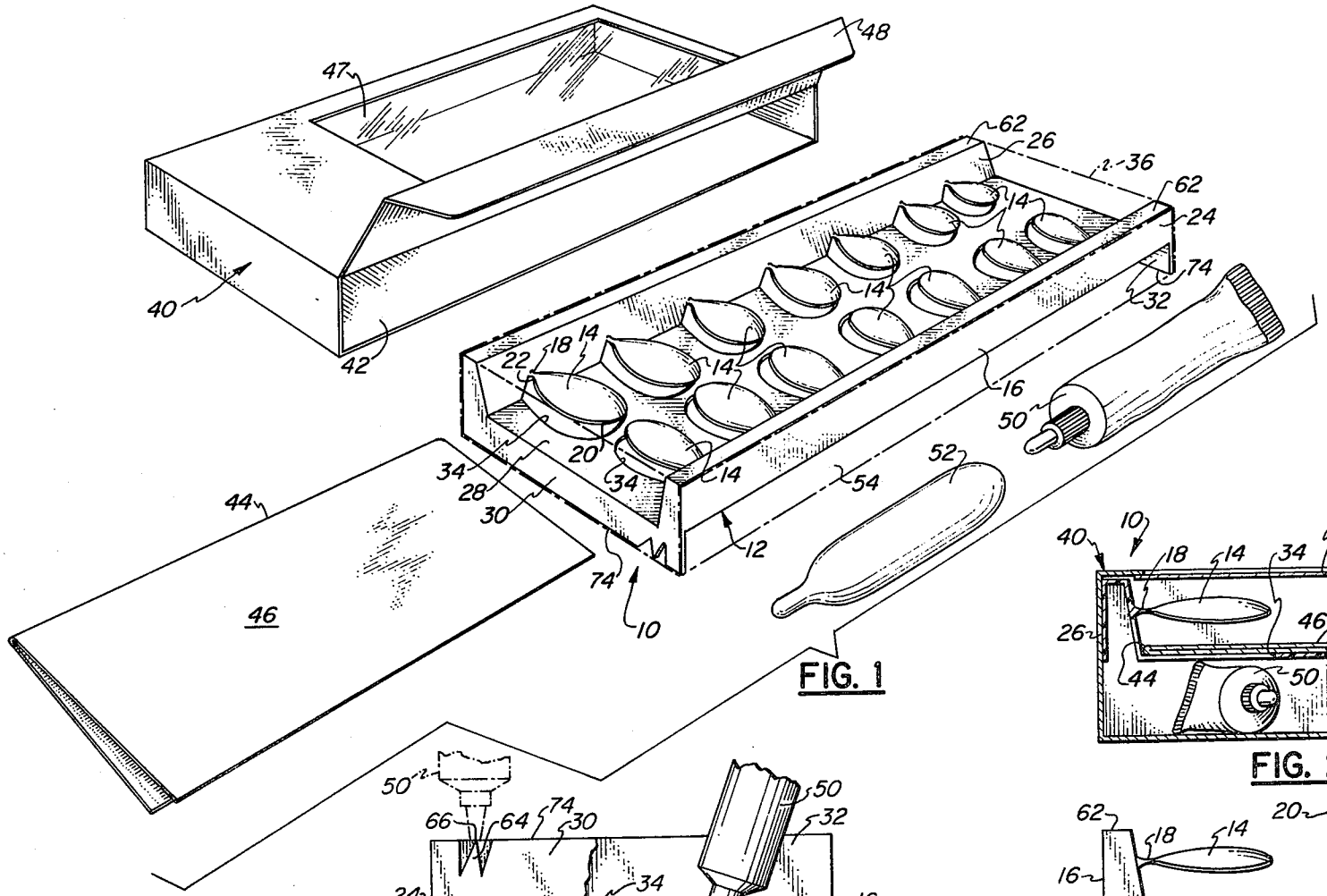
FIG. 1 is an exploded perspective view of a false fingernail kit constructed in accordance with the invention.

Referring now to the drawing, and especially to FIG. 1 thereof, a false fingernail kit constructed in accordance with the invention is illustrated at 10 and is seen to include a unitary component part in the form of tray 12 which includes a plurality of false fingernail blanks 14 unitary with a common frame 16, each blank 14 being interconnected with frame 16 at a limited portion of the blank by means of a stem 18. Each blank 14 has a configuration resembling a fingernail and includes a peripheral edge having a cuticle-matching portion 20 and a tip portion 22, the stem 18 extending from the tip portion 22. While a complete set of false fingernails would ordinarily include only ten blanks, fourteen blanks 14 are provided so as to allow for four spare blanks. Blanks 14 are of different sizes for matching the different fingers of the hands of the user.

Frame 16 includes a pair of rails 24 and 26 extending generally parallel to one another longitudinally along the frame and spaced apart laterally. A web 28 interconnects the front rail 24 with the rear rail 26 and end walls 30 and 32 depend from the rails and the web. Fingernail blanks 14 are spaced upwardly, in an altitudinal direction, from web 28 and are arranged in an aesthetically pleasing, as well as a functional pattern; that is, in order of size located side-by-side along the rails 24 and 26.

Preferably, tray 12 is fabricated by injection molding the component part of a synthetic resin material. The material may be provided in a neutral color or with any one of a variety of colors to enable the user to choose from kits of various colors whichever color is desired for the completed false fingernails. Where tray 12 is so molded, web 28 will have an opening 34 beneath each blank 14. Since all of the blanks 14 are molded integral with frame 16, the entire set of false fingernail blanks is rendered relatively easy to manufacture and to handle for subsequent packaging and use, as will now be explained.

The dimensions of frame 16 in the longitudinal, lateral and altitudinal directions is such that the frame extends beyond the pattern occupied by the blanks 14 in each of these directions. Thus, the frame 16 establishes an imaginary envelope, illustrated in phantom at 36, within which the blanks 14 are enveloped. A receptacle in the form of a carton 40 has an internal configuration complementary to the envelope 36 so that the frame 16 may be received within the carton 40, through opening 42 thereof, and will serve as a reinforcing member within the carton.

Prior to placing tray 12 within carton 40, an instruction sheet 44 is slipped between the blanks 14 and the web 28 and rests on the web within the envelope 36. The upper face 46 of the instruction sheet may be provided with a color which contrasts favorably with the color of the blanks 14 so that the combination of the blanks 14 and the background provided by the face 46 of instruction sheet 44 will have an aesthetically appealing appearance.

Figure 2:
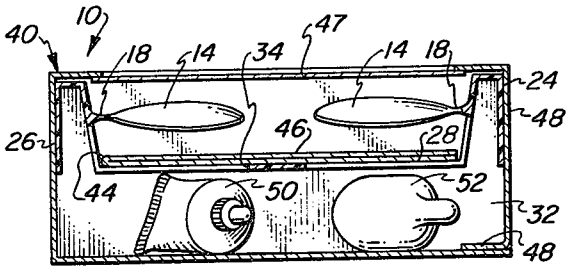
FIG. 2 is a lateral cross-sectional view of the assembled kit.

Once the instruction sheet 44 is in place between the blanks 14 and web 28, tray 12 is placed in carton 40, as seen in FIG. 2. Carton 40 includes a window 47 juxtaposed with at least some of the blanks 14. In this instance, window 47 overlies the ten blanks 14 of varying size which can be used to make up a complete set of false fingernails so that these blanks can be viewed after the kit is assembled. Prior to closing the cover 48 of carton 40, the kit 10 is completed by placing a container of adhesive, shown in the form of tube 50, and a container of adhesive remover, shown in the form of capsule 52, within a compartment 54 defined within envelope 36 by web 28 and end walls 30 and 32 of tray 12. After placing tray 12, with sheet 44 therein, in carton 40 and then placing tube 50 and capsule 52 within compartment 54, the cover 48 is closed and assembly of kit 10 is complete. The complete kit 10 makes a compact package which is easy to handle and ship and has an aesthetically pleasing appearance.

When it is desired to use kit 10, the user removes the contents of carton 40. Instruction sheet 44 is then slipped from between the blanks 14 and web 28 and opened for consultation. Tray 12 is then placed upon a support surface 60, in the orientation illustrated in FIG. 3, with rails 24 and 26 providing first basal surfaces 62 upon which the tray is supported. Basal surfaces 62 are spaced from blanks 14 in an altitudinal direction. End wall 30 is provided with a pointed projection 64 which now projects upwardly to expose the point 66 thereof. Tube 50 is then pierced at 68, with the point 66 of projection 64, to enable dispensing of the adhesive 70 in the tube. Adhesive 70 is then applied to the undersurfaces 72 of blanks 14 while the blanks are still attached to the frame 16. The undersurfaces 72 are accessible for adhesive application through openings 34.

Figure 4:
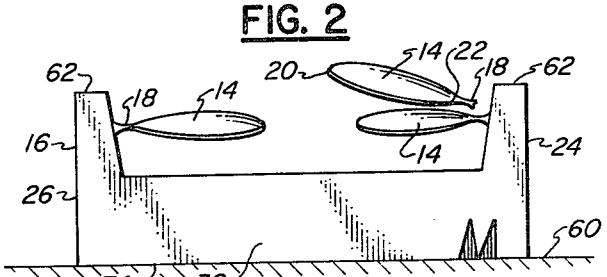
FIG. 4 is an end elevational view of the component part of FIG. 3, but in another position.
Figure 3:
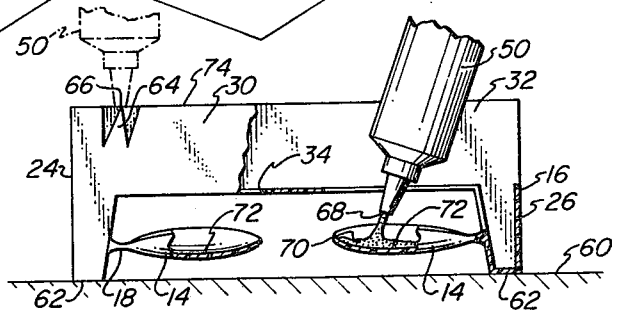
FIG. 3 is an end elevational view of a component part of the kit in one position during use of the kit.

Once the adhesive is applied to all of the blanks 14 which are to be used, the tray 12 is inverted and placed upon support surface 60 in the position shown in FIG. 4. In this position, the tray 12 rests upon second basal surfaces 74 provided by the end walls 30 and 32. Second basal surfaces 74 are spaced from blanks 14 in an altitudinal direction opposite to the direction in which the first basal surfaces 62 are spaced so that the positions of tray 12 illustrated in FIGS. 3 and 4 are inverted relative to one another. Now each blank 14 to which adhesive has been applied may be grasped and torn from frame 16 by snapping a corresponding stem 18. The limited portion provided by each stem 18 is small enough to render the stems breakable and enable the blanks 14 to be torn manually from the frame 16 without mutilation of the blanks. The spacing between adjacent blanks 14 is great enough to enable access to each blank for grasping the blank manually. The blank 14 which has been freed from frame 16 is then placed upon the user's natural fingernail. Proper placement can be attained readily by manipulating the blank 14, using as a handle the portion of stem 18 which projects from the tip portion 22 of the blank. When all of the blanks have been applied to the user's natural fingernails, the blanks may be trimmed and shaped with ordinary manicuring tools to remove the stems 18 and arrive at the desired false fingernail configuration.

When it is desired to remove the false fingernails from the user's natural fingernails, the capsule 52 is punctured, again using the pointed projection 64, and the remover is made available for use.

Thus, kit 10 attains heretofore unavailable ease of manufacture, handling and use of false fingernails.

It is to be understood that the above detailed description of an embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. In a false fingernail kit, the improvement comprising:

a unitary structure including a plurality of false fingernail blanks; and a frame unitary with each of the false fingernail blanks, said frame including basal surfaces for resting the frame upon a support surface;

each false fingernail blank being interconnected with the frame at a limited portion of the blank, said limited portion being small enough to enable the blank to be torn manually from the frame without mutilation of the blanks;

the frame including a pair of longitudinally extending rails spaced laterally from one another and joined together by an interconnecting web;

the blanks extending laterally from each rail toward the other rail and being spaced altitudinally from the web;

said basal surfaces being spaced from said blanks in opposite altitudinal directions therefrom such that the frame is capable of resting upon the support surface in either of two positions, one of which positions is inverted relative to the other.

2. The invention of claim 1 wherein:

the plurality of false fingernail blanks is arranged in a pattern;

the frame has portions thereof extending beyond the pattern to define an envelope within which the blanks are enveloped; and the kit includes a receptacle having an interior configuration complimentary to said envelope for receiving the frame and enclosing the frame and the blanks within a package;

the receptacle having a window juxtaposed with said pattern for viewing the blanks when inside the package; and a background sheet located on the frame between the web and the blanks.

3. The invention of claim 2 wherein the frame has portions defining a compartment within said envelope, and the kit includes a container of adhesive in the compartment, and a container of adhesive remover in the compartment.

* * * * *